US005938327A

United States Patent [19]

Benskin et al.

[11] Patent Number: 5,938,327

[45] Date of Patent: Aug. 17, 1999

[54] STATIC MIXER APPARATUS WITH ROTATIONAL MIXING

[76] Inventors: Charles O. Benskin, 14528 Pleasant Valley Rd., South Beloit, Ill. 61080; Paul Ingalls, 1504 Jasmine La., Plano, Tex. 75074

[21] Appl. No.: 08/975,092

[22] Filed: Nov. 20, 1997

[51] Int. Cl.[6] ..... B01F 5/04

[52] U.S. Cl. ..... 366/137.1; 366/165.1; 366/173.2

[58] Field of Search ..... 366/101, 107, 366/137.1, 162.4, 163.1, 163.2, 167.1, 173.1, 173.2, 177.1, 181.6, 336, 165.1

[56] References Cited

U.S. PATENT DOCUMENTS

| | | | |
|---|---|---|---|
| 2,460,884 | 2/1949 | Hjort et al. | 366/137.1 |
| 2,746,728 | 5/1956 | Pomerleau | 366/173.2 |
| 2,795,403 | 6/1957 | Mead | 366/163.2 |
| 3,776,702 | 12/1973 | Chant | 366/162.4 |
| 4,051,204 | 9/1977 | Muller et al. | 366/163.2 |
| 4,086,663 | 4/1978 | Croft | 366/137.1 |
| 5,262,047 | 11/1993 | Benskin et al. . | |
| 5,318,708 | 6/1994 | Benskin et al. . | |
| 5,322,623 | 6/1994 | Benskin et al. . | |
| 5,507,573 | 4/1996 | Hiorth | 366/137.1 |
| 5,520,456 | 5/1996 | Bickerstaff | 366/137.1 |
| 5,660,466 | 8/1997 | Hopson et al. | 366/173.2 |

*Primary Examiner*—Charles E. Cooley

[57] ABSTRACT

A static mixing apparatus having a mixing chamber in fluid communication with opposed conduits connected to a flow from a source of material for mixing. The conduits each include nozzles directing the flow from the conduits in different radial directions in the mixing chambers and creates a spinning flow with a resulting turbulence and shear in the mixing chamber. This spinning action produces a substantial interaction and mixing of the various components. A material in the form of a solid, liquid or gas is introduced into the chamber or the flow from a source of material.

9 Claims, 1 Drawing Sheet

STATIC MIXER APPARATUS WITH ROTATIONAL MIXING

BACKGROUND OF INVENTION

1. Field of the Invention

This invention relates to mixing apparatus and more specifically, to a static mixing apparatus for mixing fluids and solid and having no moving parts.

2. Description of the Prior Art

Countless designs of apparatus have been developed to mix solids and fluids with other fluids for purposes of manufacture, food processing, treatment of liquids, chemical processes and other applications. Many known mixers relied on mechanical moving parts to mix the various substances. Moving parts in a mixer require substantial energy input and are subject to maintenance problems, including wear and clogging restraints. Previous mechanical-type mixers have also not proven satisfactory for use for a wide range of fluids and under diverse conditions of temperature, pressure, and viscosity. Static mixers have been developed to overcome some of the problems associated with more mechanical mixers. Although the static mixer, of known types, have attained advantageous results over other types of mixing equipment, such as in the area of economy, these designs do not achieve maximum mixing efficiency in a highly economic manner.

SUMMARY OF THE INVENTION

It is therefore an objective of the present invention to provide a static mixing apparatus having no moving mechanical parts. The mixing apparatus herein disclosed includes a mixing chamber in which a liquid for mix is divided and directed through angularly oriented nozzles into a mixing chamber into which a product to be mixed, such as a powder, liquid or air for countless purposes is introduced. The mixing apparatus of the invention is highly efficient over a wide range of temperatures, flow rates, viscosity, pH levels, and other variable physical conditions. The improved mixing action is attained by mixing nozzles which minimize damage to the mixing product. The mixing apparatus is capable of use in a wide range of technologies and processes in which mixing of substances is required, such as, for example, food processing, petrochemicals, mixing of plastics, slurries, emulsions, sanitary treatment, aeration or gasification of fluids, and other diverse applications. The static mixer apparatus herein disclosed is highly economical to manufacture and to operate and is operational for sustained periods without undesired interruption of its mixing function.

The present invention provides a static mixer apparatus having a chamber means for mixing the materials from first and second sources. An inlet conduit means connects to the first source for introducing a first flow of at least one mixing material from the first source. An adductor means connects to the second source for introducing a second flow of at least one material from the second source. The inlet conduit means includes a first conduit and a pair of branch conduits connected to the first conduit for dividing the first flow. The pair of branch conduits are in fluid communication with the chamber means, and the adductor means are in fluid communication with the first flow. The mixer apparatus also incorporates nozzle means mounted adjacent the chamber means and in fluid communication with the pair of branch conduits and the chamber means. The nozzle means causes rotation of the divided flow from two branch conduits in opposite directions into said chamber means. Specifically, the nozzle means includes a pair of opposite members respectively connected to the pair of branch conduits. The pair of opposite members have a plurality of flow passages extending through them. The plurality of the flow passages of one of the opposite members has an orientation for directing the flow from the plurality of the one of the opposite members in a first radial direction in the chamber means. However, the plurality of the flow passages of the other of the opposite members has an orientation for directing the flow from the plurality of the other of the opposite members in a second radial direction in the chamber means different from the first radial direction. The different radial directions of the flows from the flow passages two opposite members causes opposed rotation of the divided flow from the two branch conduits in the chamber means to achieve improved mixing.

DESCRIPTION OF THE PREFERRED EMBODIMENT

Figure 1:
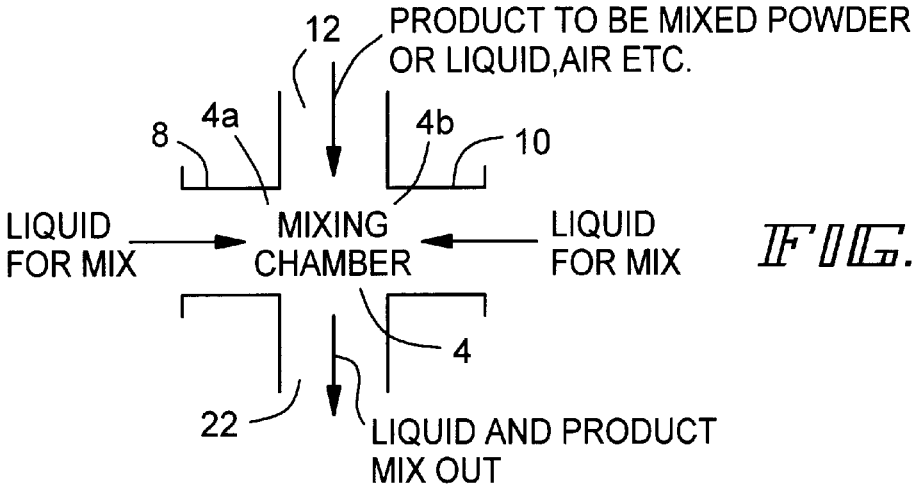
FIG. 1 is a side elevational schematic view of the static mixing apparatus of the invention.
Figure 2:
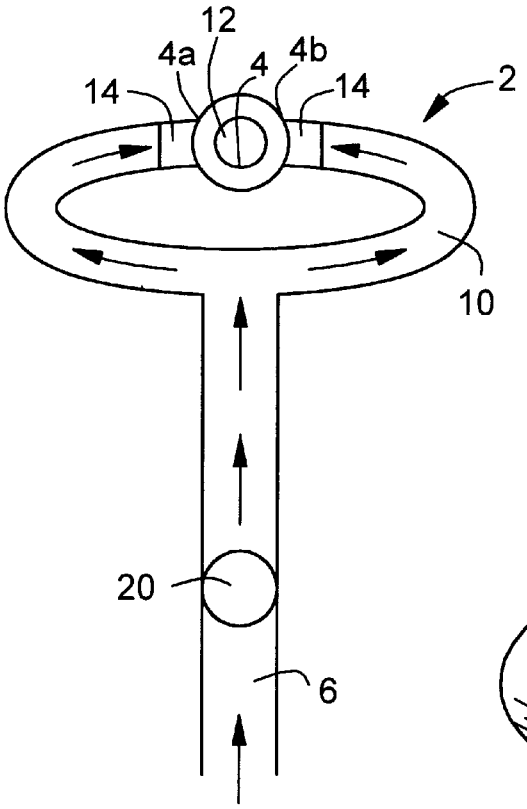
FIG. 2 is a top plan view of the static mixing apparatus of FIG. 1.
Figure 3:
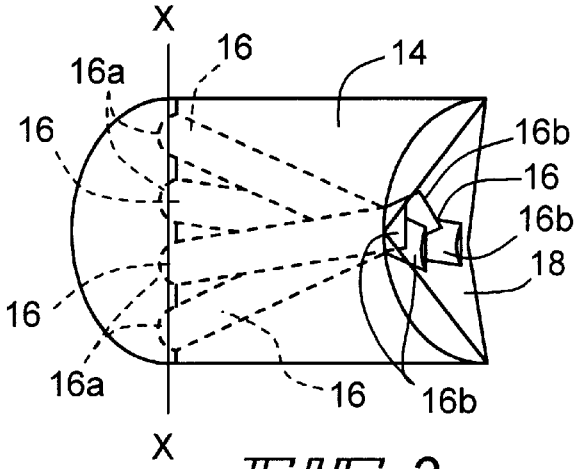
FIG. 3 is a side elevational view of the nozzle members of the static mixing apparatus of the invention.
Figure 4:
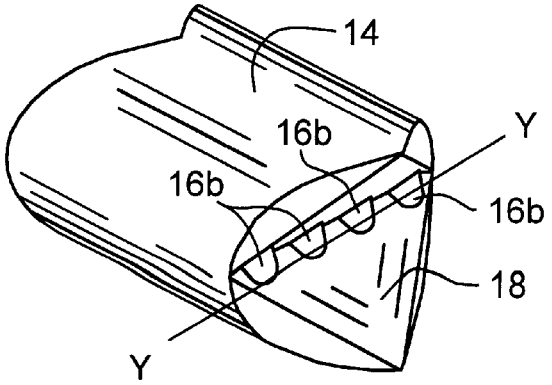
FIG. 4 is a front perspective view of the nozzle member of FIG. 3.

Referring to FIGS. 1 and 2, there is illustrated the static mixing apparatus of the invention, generally designated by the reference numeral 2. The static mixing apparatus 2 has no moving mechanical parts and is capable of mixing a product, such as, for example, a powder or other solid, liquid, and gas of numerous types with a liquid for industrial processes, food processing, petrochemicals, mixing of chemical, sanitation treatment, slurries, emulsions, pharmaceuticals, aeration or gasification of fluids, and other applications in which effective mixing of solids with liquids is needed. Since the system of the invention is static and uses no moving parts, effective mixing is possible over wide ranges of temperature, viscosity, pressure, pH levels, materials, and other conditions affecting mixing. The static mixing apparatus 2 is highly efficient in requiring a relatively small pressure level for operation and is capable of a long lifetime of service without operational interruption.

Static mixing apparatus 2 includes a mixing chamber 4 of cylindrical configuration or the like in which a solid, liquid, or gas is mixed with a liquid or slurry. A liquid for mix inlet pipe 6 delivers a predetermined flow of liquid to two separate inlets 8 and 10 forming yokes. The flow through inlet line 6 is established by any conventional technique. The mixing chamber is provided with two inlets 4*a* and 4*b* respectively provided in fluid communication with inlet lines 8 and 10. An upper port 12 or adductor delivers the liquid, air, or solid by gravity flow into the mixing chamber 4 for action with the divided streams being introduced through inlets 4*a* and 4*b*.

A pair of opposed nozzle members 14 having plurality of obliquely extending passageways 16, such as four in number, having inlets 16*a* and outlets 16*b* and being in fluid communication with inlets 4*a* and 4*b* are mounted in inlet lines 8 and 10. The plurality of flow passages may have inlets obliquely arranged in relation to the divided flow through the pair of branch conduits. The nozzle members 14 are commercially available and sold under the trademark ISG Mixer by Ross Engineering, Inc. of Savannah, Ga. The flow through the plurality of passageways 16 of one of the nozzle members is directed radially in a different direction than the flow from the opposite passageways of the other of the nozzle members to cause a spinning flow for radial mixing through a shearing effect. The flows collide to create significant turbulence in the chamber 4. The ends of each of the nozzle members 14 are formed with a tetrahedral shape 18 for creating multiple generation of spinning streams. The nozzles 16 as well as the pipes of the invention may be fabricated from plastic or steel.

As further seen in FIG. 2, the static mixing apparatus 2 can include an addition adductor 20 to introduce the product to be mixed in form of a powder, liquid, air and the like into inlet pipe 6 upstream of the mixing chamber 4. The adductor 20 may be provided instead of adductor 12 or both combined on a static mixing apparatus 2. As further seen in FIG. 1, the mixed product is drawn out through lower outlet 22 with or without a pressure reducing technique (not shown).

What is claimed:

1. A static mixer apparatus comprising chamber means for mixing the materials from first and second sources, inlet conduit means connected to the first source for introducing a first flow of at least one mixing material from the first source, adductor means connected to the second source for introducing a second flow of at least one material from the second source, said inlet conduit means including a first conduit and a pair of branch conduits connected to said first conduit for dividing said first flow, said pair of branch conduits being in fluid communication with said chamber means, said adductor means being in fluid communication with said first flow, nozzle means being mounted adjacent said chamber means in fluid communication with said pair of branch conduits and said chamber means for causing rotation of the divided flow from one of said branch conduits and the other of said branch conduits in opposite directions into said chamber means, and said nozzle means including a pair of opposite members respectively connected to said pair of branch conduits, said pair of opposite members having a plurality of flow passages extending through said pair of opposite members, said plurality of said flow passages of one of said opposite members having an orientation for directing the flow from said plurality of said one of said opposite members in a first radial direction in said chamber means and said plurality of said flow passages of the other of said opposite members having an orientation for directing the flow from said plurality of said other of said opposite members in a second radial direction in said chamber means different from said first radial direction for causing opposed rotation of the divided flow from said two branch conduits in said chamber means.

2. The static mixer according to claim 1 wherein said plurality of flow passages has inlets obliquely arranged in relation to the divided flow through the pair of branch conduits and said plurality of flow passages also has outlets lying near the center of said opposite members on the outlet side of said opposite members to cause spinning flow of the divided portions of said first flow.

3. The static mixer according to claim 2 wherein said adductor means is in fluid communication with said chamber means.

4. The static mixer according to claim 3 wherein said adductor means is mounted above said chamber means.

5. The static mixer according to claim 3 wherein said adductor means introduces solid materials to be mixed.

6. The static mixer according to claim 3 wherein said adductor means introduces fluids to be mixed.

7. The static mixer according to claim 2 wherein said static mixer is in fluid communication with said inlet conduit means.

8. The static mixer according to claim 7 herein said adductor means is mounted above said inlet conduit means.

9. The static mixer according to claim 1 further including outlet means in fluid communication with said chamber means for withdrawing the mixed materials.

* * * * *